United States Patent [19]

Lockwood et al.

[11] 4,276,016

[45] Jun. 30, 1981

[54] WICK DEVICE

[76] Inventors: Francis R. Lockwood, 5509 Goldenrod Rd., Louisville, Ky. 40272; Kenneth P. Meuse, 9211 Calvacade Ave., Louisville, Ky.

[21] Appl. No.: 24,578

[22] Filed: Mar. 28, 1979

[51] Int. Cl.[3] ..... F23D 3/18

[52] U.S. Cl. ..... 431/323

[58] Field of Search ..... 431/298, 325, 276, 277, 431/151, 321, 323, 320

[56] References Cited

U.S. PATENT DOCUMENTS

| | | | |
|---|---|---|---|
| 467,736 | 1/1892 | Fernelmont | 431/323 X |
| 1,412,704 | 4/1922 | Osborne | 431/323 X |
| 1,662,058 | 3/1928 | Hargraft | 431/323 |

FOREIGN PATENT DOCUMENTS

| | | | |
|---|---|---|---|
| 946696 | 5/1947 | France | 431/323 |
| 393471 | 5/1922 | Netherlands | 431/320 |
| 922539 | 4/1963 | United Kingdom | 431/323 |

*Primary Examiner*—Samuel Scott
*Assistant Examiner*—Randall L. Green
*Attorney, Agent, or Firm*—Edward M. Steutermann

[57] ABSTRACT

A wick assembly to advantageously supply a flammable fluid from a reservoir at a selected rate including a reservoir means to hold a supply of the flammable fluid and having an outlet aperture in the top thereof, a generally cylindrical elongate dip tube having at least one perforation in the side thereof and adapted to be received in the reservoir and to be secured to the outlet aperture where an open end of the dip tube extends through the aperture of the reservoir so the dip tube is disposed in the reservoir to permit the flammable liquid to be emitted through the perforations to the interior of the dip tube, a wick feed assembly including a cap adapted to be received in the open end of the dip tube and having a first open end tube extending through the cap and adapted to receive first wick means to extend through the length of the first open end tube so the wick is received in the dip tube and the other end of the wick extends out of the first tube, second elongate tube means having one closed end and adapted to be received within the dip tube with an open end received within the cap, a third, cylindrical elongate tube having at least one perforation in the side thereof and adapted to receive second wick means, and further adapted to be received within the second tube, where the first wick means extends from the end of the first tube and into the second tube whereby flammable liquid is conducted, by wicking, from the reservoir by the first wick means through the first tube and second tube means where the flammable liquid is thereby conducted to the third tube through the apertures of the second tube to the third wick means and where the wick feed assembly is received within the dip tube.

1 Claim, 2 Drawing Figures

WICK DEVICE

BACKGROUND OF THE INVENTION

The present invention relates to devices for supplying a flammable fluid to a burner by means of "wicking" where the rate of flow of the fluid can be selectively controlled by the porosity of the wick means.

The present invention more particularly applies to a wick arrangement for use, for example, in cigarette lighters where it is desirable to provide a flammable fluid wet wick which can be readily ignited by means of a spark for the purpose of lighting cigarettes, other tobacco products or providing ignition for other purposes.

Past lighter arrangements have operated successfully in outdoor applications but are not likewise suitable for indoor operation because the construction provides a fuel inter-mixture which is too rich.

Moreover, prior art wicking assemblies as shown in U.S. Pat. No. 2,881,608, J. C. Lockwood, have provided arrangements including a reservoir to store a flammable fluid where a second chamber is provided utilizing a valve arrangement between the reservoir and the second chamber for admission of the flammable fluid to the second chamber thence to the ignition area by means of wicking.

In the arrangement shown in the above-noted patent, and in other similar arrangements, it has been necessary to selectively admit a quantity of fluid to the wicking arrangement prior to ignition of the lighter. Furthermore, the period of burn of the lighter is limited by volume of the second chamber.

Other arrangements have provided no such second chamber and in such arrangements the rate of evaporation of the flammable fluid is totally uncontrolled and is a function of the relative clearance between the wick and the lighter body so that excessive fluid loss occurs both by evaporation and by simple leakage when the lighter is stored in an inverted position.

In arrangements as shown in U.S. Pat. No. 2,881,608, the introduction of the mechanical valve between the reservoir and the second chamber, while satisfactory for some purposes, limits the useful life of the lighter in that whereon the seals of the transfer valve ultimately results in effective failure of the lighter and thereby limits the lifespan of the lighter.

Additionally, the use of the transfer valve between the reservoir and the second chamber increases the costs of the lighter assembly and complicates the fabrication of the lighter.

No device is presently known, for use with a lighter assembly or burner arrangements utilizing a flammable fluid and a wicking device where an arrangement is provided to internally and continuously supply a quantity of flammable fluid to a wicking arrangement where it is not necessary to periodically introduce additional fluids through a second chamber for supply to the burning area of the wick and where a valve arrangement is not needed.

SUMMARY OF THE INVENTION

The present invention provides a new and novel wick-feed arrangement for use in a burner device where a selected flammable fluid is to be provided to be burned on a wick and where the flammable fluid is contained in a reservoir and is withdrawn from the reservoir through a wick-feed assembly at a rate determined solely by the characteristics of the wick used.

Devices within the scope of the present invention are particularly useful in that they require no second chamber in the lighter to provide a second fuel reservoir to hold a preselected quantity of fuel prior to feeding the fuel to the wick for burning. Additionally, the present invention provides a lighter arrangement which will burn continuously until exhaustion of the fuel in the reservoir so that it is not necessary to periodically replenish the supply of fuel in a second chamber. Additionally, the present invention provides an arrangement which does not require a transfer valve utilized in prior art arrangements for feeding a preselected quantity of flammable fuel to a second chamber and thereby eliminate the difficulties inherent in the use of such a valve arrangement. Additionally, the present invention, by eliminating the use of the previously used transfer valve, extends the useful life of the lighter. Moreover, devices in accordance with the present invention eliminate unnecessary loss of flammable fluid through evaporation by means of devices provided within the scope of the present invention and therefore realize fuel economy.

More particularly, the present invention provides a wick assembly to advantageously supply a flammable fluid from a reservoir at a selected rate including a reservoir means to hold a supply of the flammable fluid and having an outlet aperture in the top thereof, a generally cylindrical elongate dip tube having at least one perforation in the side thereof and adapted to be received in the reservoir and to be secured to the outlet aperture where an open end of the dip tube extends through the aperture of the reservoir so the dip tube is disposed in the reservoir to permit the flammable liquid to be emitted through the perforations to the interior of the dip tube, a wick feed assembly including a cap adapted to be received in the open end of the dip tube and having a first open end tube extending through the cap and adapted to receive first wick means to extend through the length of the first open end tube so the wick is received in the dip tube and the other end of the wick extends out of the first open end, second elongate tube means having one closed end and adapted to be received within the dip tube with an open end received within the cap, a third, cylindrical elongate tube having at least one perforation in the side thereof and adapted to receive second wick means, and further adapted to be received within the second tube, where the first wick means extends from the end of the first tube and into the second tube whereby flammable liquid is conducted by wicking, from the reservoir by the first wick means through the first tube and second tube means where the flammable liquid is thereby conducted to the third tube through the apertures of the second tube to the third wick means and where the wick feed assembly is received within the dip tube.

Various other arrangements within the scope of the present invention will become obvious to those skilled in the art upon reading the disclosure set forth hereinafter.

BRIEF DESCRIPTION OF THE DRAWINGS

One example of an arrangement within the scope of the present invention is shown in the figures wherein:

Referring now to FIG. 1 which shows one example of a wicking device within the scope of the present invention, the device is shown in terms of a lighter including, for example, a reservoir 1 as commonly utilized in a lighter arrangement where a chamber 2 is defined within the reservoir to hold a supply of flammable fluid, for example, commonly known as lighter fluid.

Figure 1:
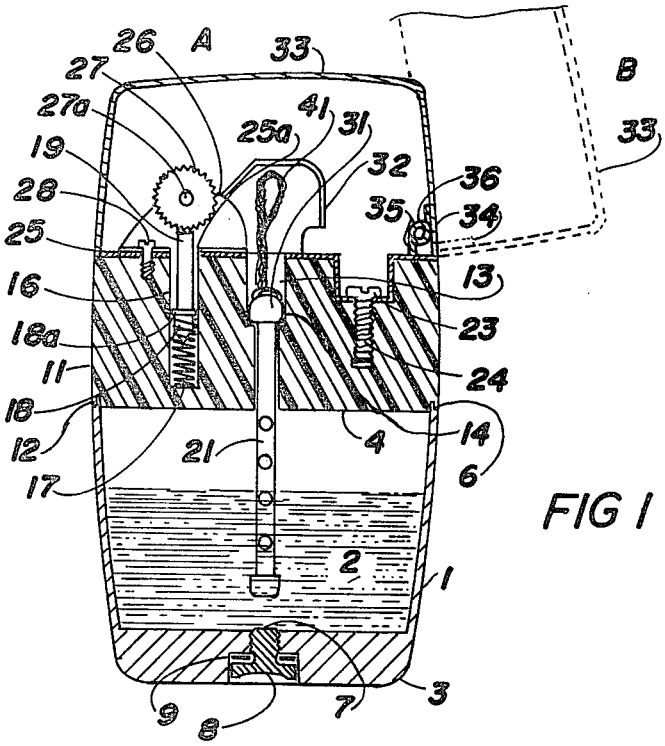
FIG. 1 is an illustration, partly in section, of one arrangement within the scope of the present invention.

Reservoir 1 can be formed of transparent material with an endwall 3 and an open end 4. Open end 4 is defined by a peripheral edge 6. As shown, a filling passage 7 can be provided to be fitted with a threaded plug 8 where a seal 9 can be provided between the inner surface of endwall 3 and the bottom surface of plug 8. A center portion 11 can be provided, and can be fabricated, for example, of a suitable plastic, having a lower edge 12 adapted to receive peripheral edge 6 of reservoir 1 as shown to fully define chamber 2. A cooperative aperture 13, as shown, can be provided to extend through center portion 11 for admission of a wick assembly 21 described hereinafter.

It will be noted that a recess 14 is provided and adapted to receive a cap 31 of wick assembly 21 and a wick 41 is provided to extend outwardly from cap 31 above the upper surface of center portion 11. Additionally, an aperture 16 can be provided in center portion 11 to receive a flint follower 18 and a flint 19 as described hereinafter.

A body cap 22 is provided to overlie center portion 11 where center portion 11 is provided with a recess 23 adapted to receive a screw 24 to be secured, by threads, in center portion 11 to hold body cap 22 in place. A sparkwheel 27 is provided to be journalled in a yoke 26, as is known in the art by means of a pivot 27A where yoke 26 includes a base 25 adapted to be secured to center portion 11 by means of a screw 28 which, advantageously, also secures an end of body cap 22. Advantageously, an aperture 25A is provided in base 25 to permit flint 19 to pass therethrough but to retain the peripheral lip 18A of follower 18. In the arrangement shown, spring 17, as is known in the art, urges follower 18 and flint 19 upwardly into engagement with the roughen surfaces of sparkwheel 27 to provide a spark when the wheel is turned. The spark is directed toward wick 41.

Also, a wind-protecting baffle 32 can be provided on body cap 22 as shown and as known in the art.

A cap 33 can be provided to overlie body 22 where cap 33 is secured to a spring 36 having two radially extending ends 34 and 35 where end 34 is affixed to cap 33 and end 35 is affixed to center portion 11. Thus, the arrangement can be provided where cap 33 is pivoted and lifted from position A to position B by means of spring 36 to provide access to the operative elements of the lighter.

Figure 2:
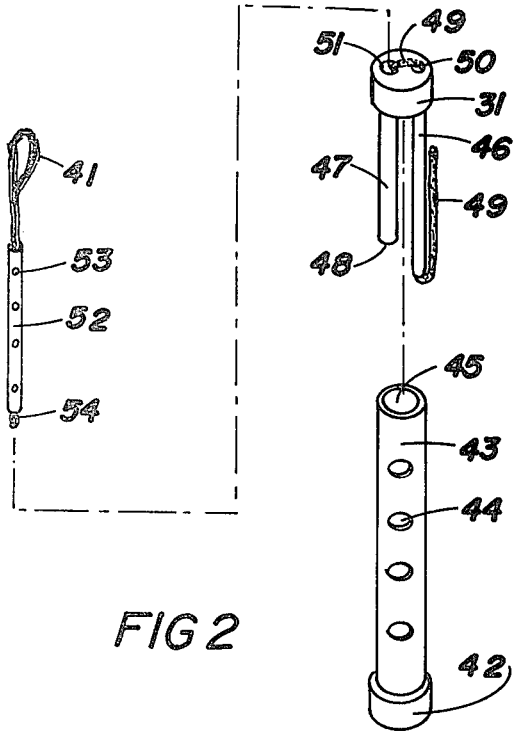
FIG. 2 is an exploded view of one example of a wick assembly within the scope of the present invention for use in the arrangement shown in FIG. 1.

FIG. 2 is an illustration of one example of a wick assembly 21 within the scope of the present invention.

In the arrangement shown in FIG. 2, a dip tube 43 is provided having apertures 44 for admission of fluid stored in chamber 2. Dip Tube 43 is provided with two open ends where only one open end 45 is shown in FIG. 2. The second end may be, for example, by means of a cap where the open end 45 adapted to receive a cap 31. Cap 31 can be provided with a first tube 46, as shown, having an open ends 50 and 50*a* where first tube 46 extneds through one aperture provided in cap 31 and the open end 50 is flush with the top of cap 31. A second tube 47 can be provided where second tube 47 an extends through an aperture (not shown) provided in cap 31 and has open end 51 flush with the top of cap 31 and a closed end 48. A first wick 49 can be provided to extend outwardly from tube 46 and in the example shown is turned upwardly adjacent tube 46 while the other end of wick 49 extends out of opening 50 of tube 46 and downwardly through opening 51 to tube 47. The entire assembly is adapted to be received within tube 43 so that the flammable fluid from chamber 2 soaks wick 49, passes upwardly through the portion of wick 49 in tube 46 and into tube 47. A third tube 52 is of smaller diameter than second tube 47 provided, having apertures 53 and an open end 54 where a portion of a second wick 41 extends downwardly through tube 52 and can extend through an open end 54 of third tube 52. Tube 52 is adapted to be received through opening 51 and into tube 47 so that flammable fluid from wick 49 is admitted to wick 41 by means of apertures 53 and by means of opening 54 when such an opening is provided. The entire assembly is then received in the center portion 11 of the lighter shown in FIG. 1 so that the flammable fluid is admitted through apertures 44 to wick 49 and conducted, by wicking, to tube 47 where the material is then transferred to wick 41 which can be ignited by rotation of sparkwheel 27.

It will be realized that the foregoing is but one example of an arrangement in accordance with the present invention and that various other arrangements within the scope of the present invention will occur to those skilled in the art upon reading the disclosure set forth hereinbefore.

The invention claimed is:

1. A wick assembly to supply a flammable fluid from a reservoir at a selected rate including; (a) reservoir means to hold a supply of flammable fluid and having an outlet aperture in the top thereof; (b) a generally cylindrical elongate dip tube having an open end and at least one perforation in the side thereof and adapted to be received in said reservoir; (c) means to secure said open end of the dip tube to and within said outlet aperture so said dip tube extends through said reservoir to permit the flammable liquid to be admitted through said perforation to the interior of said dip tube; (d) a wick feed assembly including a cap adapted to be received in said open end of said dip tube where a first open end tube extends through said cap and is adapted to receive first wick means to extend through the length of said first open end tube so said first wick is received in said dip tube with the other end of said first wick extending out of said open end first tube, (e) second elongate tube means having one closed end and adapted to be received within said dip tube with an open end received within said cap; (f) a third, cylindrical elongate tube having at least one aperture in the side thereof, and adapted to receive second wick means, and further adapted to be received within said second tube, where said first wick means extends from the end of the first tube and into the second tube whereby said flammable liquid is conducted, by wicking, from the reservoir by said first wick means through said first tube and said second tube means where said flammable liquid is thereby conducted to said third tube through said at least one aperture of said third tube to said second wick means.

* * * * *